United States Patent [19]

Deane

[11] 3,940,966

[45] Mar. 2, 1976

[54] APPARATUS FOR SHAPING SHEET MATERIAL

[75] Inventor: Norman Philip Deane, Rugby, England

[73] Assignee: Covrad Limited, Coventry, England

[22] Filed: Dec. 2, 1974

[21] Appl. No.: 528,815

[30] Foreign Application Priority Data

Dec. 5, 1973 United Kingdom ..... 56412/73

[52] U.S. Cl. ..... 72/196; 72/465

[51] Int. Cl.[2] ..... B21D 13/04

[58] Field of Search ..... 72/196, 186, 465; 29/123

[56] References Cited

UNITED STATES PATENTS

| | | | |
|---|---|---|---|
| 3,123,905 | 3/1964 | Thomas | 72/196 |
| 3,712,101 | 1/1973 | Bemrose et al. | 72/196 |
| 3,830,088 | 8/1974 | Couper et al. | 72/196 |

*Primary Examiner*—Lowell A. Larson

*Attorney, Agent, or Firm*—Wheeler, Morsell, House & Fuller

[57] ABSTRACT

Apparatus for shaping sheet material such as metal foil includes co-operating rollers with teeth, between which the sheet material is fed. The teeth shape the sheet to form corrugations, and projections on the flanks of the teeth form patterns on the corrugations. In order to free the shaped sheet from the teeth, resilient material projects from the flanks of the teeth and urges the sheet away from the flanks after a shaping operation.

The invention is intended for use in forming the secondary heat exchange surfaces in aluminium radiators.

11 Claims, 7 Drawing Figures

APPARATUS FOR SHAPING SHEET MATERIAL

This invention relates to apparatus for shaping sheet material in the form, for example, of aluminium foil.

It is often necessary to shape flexible sheet material such as foil, and form a pattern on parts of the shaped surface. For example, in the construction of light alloy radiators, light alloy sheet material is corrugated and the fin areas of the corrugations are formed with louvres to assist in heat transfer when fitted to the assembled radiator. Preferably the sheet material is corrugated and provided with louvres in a single operation by passing the sheet material between a pair of co-operating toothed rollers, the flanks of the teeth being so shaped as to form the louvres in the sheet during rotation of the rollers.

A problem which has been encountered with the shaping apparatus discussed above is that the foil tends to adhere to the teeth after the shaping operation.

According to the invention there is provided apparatus for shaping sheet material, comprising two co-operating rollers each having profiled surfaces, the rollers being arranged to receive sheet material between the profiled surfaces during rotation of the rollers for forming the material into a shape dictated by the shape of the profiled surfaces, the profiled surfaces being shaped to include teeth and each tooth having flanks, the flanks being shaped to include raised portions to impart a corresponding pattern on the material, and resilient means being provided along portions of the flanks of the teeth for urging the sheet material away from the teeth after a shaping operation.

Preferably the raised portions of the flanks of the teeth are in the form of louvre cutters for cutting louvres in sheet material.

The rollers may be independently rotatable in opposite senses and the profiled surfaces of the rollers are spaced apart sufficiently to admit the sheet material.

Conveniently the teeth each include a tip and flanks, the tip extending generally circumferentially or tangentially of the axis of rotation of the respective roller and the flanks lying obliquely to a notional radial line from the axis of rotation of the respective roller.

Preferably the rollers are formed of laminae spaced along the axis of rotation of the rollers, some of said laminae including said louvre cutters and others including said resilient means.

The resilient means may comprise a replaceable rubber insert, a rubber, latex or foam coating, a moulded insert for example of a polyurethane foam or alternatively, a sheet of resilient laminar material.

Figure 1:
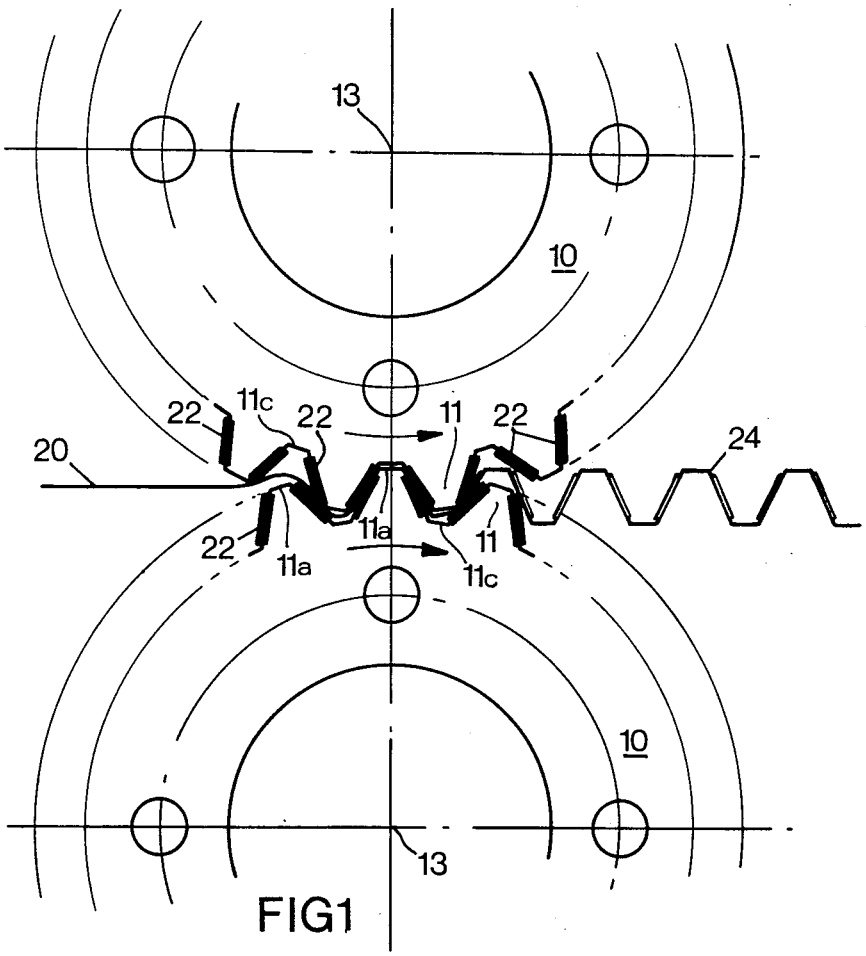
Figure 2:
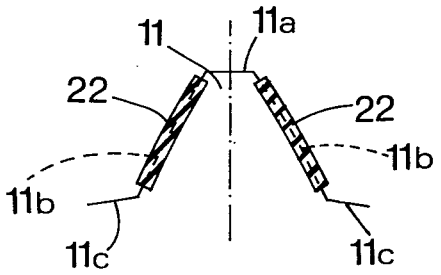
Figure 3:
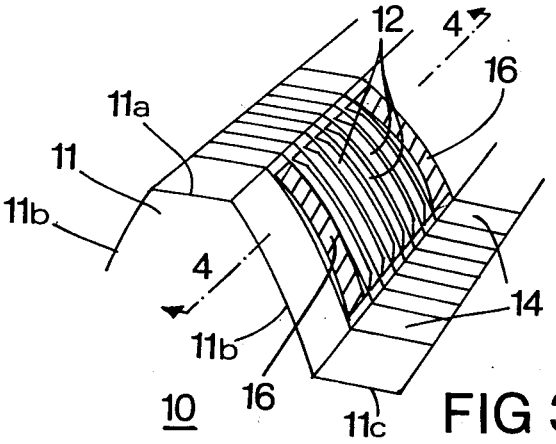
Figure 4:
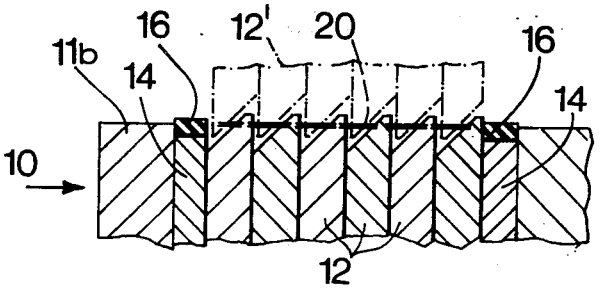
Figure 5:
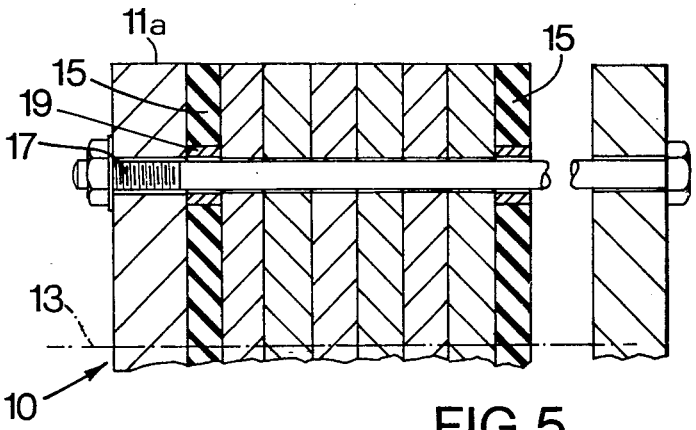
Figure 6:
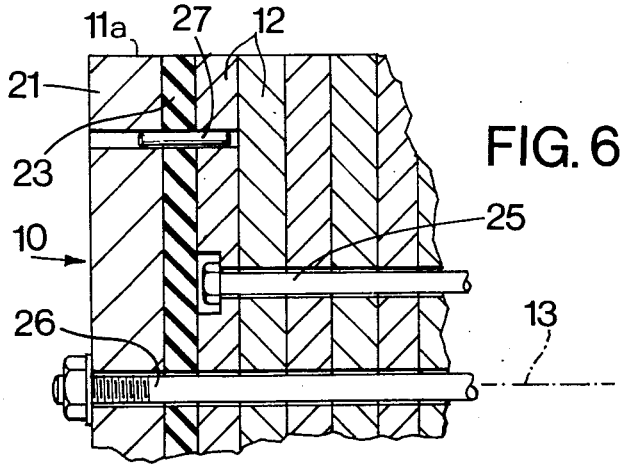
Figure 7:
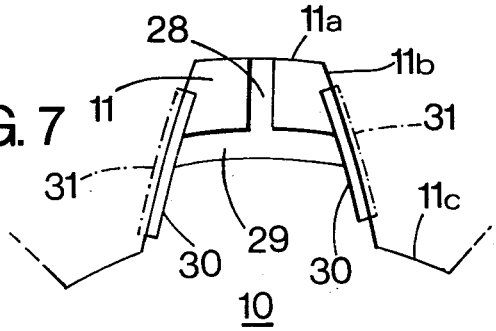

Further features of the invention will appear from the following description of embodiments of the invention given by way of example and with reference to the accompanying drawings in which:

FIG. 1 is a side elevation of rollers according to the invention embodying one form of resilient means, FIG. 2 is a side view of a tooth formed on one of the laminae embodied in the rollers of FIG. 1, FIG. 3 is a perspective view of apparatus of the invention embodying a second form of resilient means, FIG. 4 is a cross section along line 4—4 in FIG. 3, FIG. 5 is a cross section showing a third form of resilient means, FIG. 6 is a cross section showing a fourth form of resilient means, and FIG. 7 is a cross section of a tooth showing a fifth form of resilient means.

Referring to FIGS. 1 and 2 toothed rollers 10 having profiled surfaces in the form of teeth 11 are arranged to rotate in opposite directions about their axes 13. The teeth 11 (only some of which are shown) are equally-spaced about the rollers 10 and the teeth 11 on one roller are arranged to co-operate with the teeth 11 formed on the other roller. The rollers are independently driven and are arranged so that the teeth 11 do not contact one another but provide a space in which a sheet 20 of flexible material, for example aluminium foil, can be located. During passage between the rollers the sheet 20 is shaped and in passing from the rollers the sheet has adopted the corrugated form shown at 24 in FIG. 1.

The teeth 11 each comprise a flattened tip 11*a* extending circumferentially or tangentially to the axis of rotation 13 of the respective roller 10, and flanks 11*b* extending obliquely to notional radii from the axis of rotation 13 of the respective roller, at each side of the tip 11*a*. Roots 11*c* are formed between the teeth for receiving the tips 11*a* of the teeth of the co-operating roller.

The rollers are each built up from a plurality of laminae extending normal to the axis of rotation 13 and spaced along said axis, as will be more fully explained with reference to FIGS. 3 and 4. Some of the laminae are provided with resilient means in the form of resilient rubber inserts 22 which are located in the flanks 11*b* of the teeth. When in a relaxed condition the inserts 22 extend slightly beyond the surface of the flanks. Others of the laminae include louvre cutters as described below with reference to FIGS. 3 and 4.

Referring now to FIGS. 3 and 4 each roller includes laminae having louvre cutters 12 and at each side of the louvre cutters are laminae having resilient means 16. In this case the resilient means 16 is in the form of a resilient coating on both flanks 11*b* of each tool, the coating 16 projecting above the level of the flanks in the relaxed condition, as shown. The resilient coating is formed of rubber, but latex, foam or other resilient material capable of being applied as a coating may be used. If desired, an intermediate bonding layer such as a copper sulphide composition may be applied to the steel plate constituting the laminae to facilitate adherence of the resilient material. As can be seen in FIG. 4 the louvre cutters 12 comprise projections which co-operate with similar projections formed on louvre cutting teeth 12' on the flanks of the teeth of the co-operating roller 10 and the action of the teeth is to form a series of parallel louvres in the flanks or fins of the corrugated sheet material 24. Apart from the form of resilient material used, the embodiment of FIGS. 1 and 2 is the same as the embodiment of FIGS. 3 and 4.

It will be appreciated that as the sheet material 20 passes between the toothed surfaces of the rollers 10 the resilient material, whether in the form of coatings 16 or of inserts 22, becomes compressed and lies at or below the surface of the louvre cutters 12, but as the foil starts to leave the rollers the resilient material expands from its compressed state into its relaxed state hence exerting a force substantially normal to the surface of the flanks 11*b* to release the foil from the louvre cutters 12. In this way the tendency for the foil to adhere to the louvre cutters is considerably reduced.

When employing the resilient inserts 22 it is preferred that a releasable or peelable adhesive is used to secure the inserts so as to enable the inserts to be removed from the respective laminae when replacement is necessary.

If the resilient material 16 of the embodiment of FIG. 3 wears during use, it is only necessary to recoat the flanks 11*b* to maintain the effectiveness of the material 16.

Referring now to FIG. 5 the resilient material may be constituted by laminae 15 formed wholly of resilient material the outer edge of which projects beyond the surface of the flanks 11*b* of the teeth 11. Bolts 17 serve to secure the laminae making up the roller and where the bolts 17 pass through the laminae 15 a spacer sleeve 19 is provided to prevent the resilient material being compressed by the bolts 17.

In the embodiment of FIG. 6 laminae carrying the louvre cutters 12 are arranged in sets which are rigidly bolted together and, between the end of a set and a clamping plate 21 at the end of the roller, a resilient lamina 23 is located. Bolts 25 are used to secure the sets together and a central bolt 26 secures the clamping plates 21 to the sets of laminae 12. To prevent relative rotation between the clamping plates 21 and the sets of laminae 12 dowls 27 are inserted through the clamping plates 21 and the resilient laminae 23 into the laminae 12.

Referring now to FIG. 7 each lamina to which resilient means is applied has galleries 28 and 29 formed in each tooth 11, the gallery 28 extending generally radially from the tip 11*a* of the tooth and intersecting the gallery 29 extending circumferentially of the tooth. The gallery 29 leads to cavities 30 formed in the flanks 11*b* of the tooth. An injection moulding machine, including a cup-like nozzle, is located over each tooth tip 11*a* in turn and a resilient material 31 such as rubber, latex or a polyurethane foam is then injected along the gallery 28 into the gallery 29 and from thence into the cavities 30 until the material projects from the flanks 11*b* of the teeth 11. With this embodiment, when the surface of the resilient material becomes worn, the resilient material may be etched out leaving the galleries and cavities free for receiving a further injection of resilient material.

With each of these described embodiments of resilient means it is necessary that the outer surface of the resilient means projects above the level of the flanks 11*b* of the teeth 11. The extent to which the resilient material projects is dependant on the thickness of the sheet material, the stiffness of the resilient material and other factors. Typically with sheet material having a thickness of 0.007 inches the resilient material should project between 0.010 to 0.030 inches.

The profile of the resilient material extending above the surface of the flanks of the teeth may be parallel to the flanks or alternatively may be convex. The land of the resilient insert may be scored or otherwise roughened to discourage the foil from adhering thereto.

It has been proposed in British Patent Specification No. 1,359,993 to provide apparatus for shaping sheet material in which toothed tools have been provided with resilient means in the roots or tips of the tooth form to co-operate with the non-resilient tips or roots of the co-operating teeth in order to improve the formation of the corrugations in the shaped sheet material.

Apparatus to which the present invention can readily be applied is described fully in our application Ser. No. 353,510 now U.S. Pat. No. 3,830,088 issued Aug. 20, 1974.

It will be appreciated that the invention may find application in apparatus for shaping sheet material which does not take the same form as that described. For example the teeth need not have flat tips but the tips may be rounded. Similarly the flanks of the teeth may not have louvre cutters but may include other projections for forming corresponding patterns on the flanks or fins of the corrugated sheet. In each case it may be found desirable to incorporate the resilient means to assist in freeing the shaped sheet from the forming tools.

Moreover it may be found appropriate to use the apparatus of the invention in shaping other materials than aluminium foil, for example the sheet material may be of copper or brass.

What I claim and desire to secure by Letters Patent of the United States is:

1. Apparatus for shaping sheet material, comprising two co-operating rollers each having profiled surfaces, the rollers being arranged to receive sheet material between the profiled surfaces during rotation of the rollers for forming the material into a shape dictated by the shape of the profiled surfaces, the profiled surfaces being shaped to include teeth and each tooth having flanks, the flanks being shaped to include raised portions to impart a corresponding pattern on the material, and resilient means being provided along portions of the flanks of the teeth for urging the sheet material away from the teeth after a shaping operation.

2. Apparatus according to claim 1 wherein the raised portions of the flanks of the teeth are in the form of louvre cutters for cutting louvres in the sheet material.

3. Apparatus according to claim 1 wherein the rollers are independently rotatable in opposite senses and the profiled surfaces of the rollers are spaced apart sufficiently to admit the sheet material.

4. Apparatus according to claim 1 wherein the teeth each include a tip and flanks, the tip extending generally circumferentially or tangentially of the axis of rotation of the respective roller, and the flanks lying obliquely to a notional radial line from the axis of rotation of the respective roller.

5. Apparatus according to claim 1 wherein the rollers are each formed of laminae spaced along the axis of rotation of the rollers, some of said laminae including louvre cutters and others including said resilient means.

6. Apparatus according to claim 5 wherein one or more of said laminae is formed of resilient material constituting said resilient means.

7. Apparatus according to claim 1 wherein the resilient means is in the form of inserts set into recesses in the flanks of the teeth.

8. Apparatus according to claim 1 wherein the resilient means is in the form of a coating of resilient material on the flanks of the teeth.

9. Apparatus according to claim 1 wherein the resilient means is formed of resilient material which has been injected into a cavity in the flanks through channels in the teeth.

10. Apparatus according to claim 1 wherein the resilient means is parallel to or convex with respect to the surface of the flanks of the teeth.

11. Apparatus according to claim 1 wherein the resilient means projects from the flanks of the teeth and is compressed during cooperation of the raised portions of the flanks, so that the resilient means in returning to its relaxed state urges the sheet material away from the flanks of the teeth and said raised portions.

* * * * *